US010308331B2

(12) United States Patent
Wescott

(10) Patent No.: US 10,308,331 B2
(45) Date of Patent: Jun. 4, 2019

(54) SURVIVAL PLATFORM

(71) Applicant: Salvare IP Limited, Larnaca (CY)

(72) Inventor: Brett Wescott, Four Marks Hampshire (GB)

( * ) Notice: Subject to any disclaimer, the term of this patent is extended or adjusted under 35 U.S.C. 154(b) by 0 days.

(21) Appl. No.: 15/563,930

(22) PCT Filed: Mar. 29, 2016

(86) PCT No.: PCT/GB2016/050876
§ 371 (c)(1),
(2) Date: Oct. 2, 2017

(87) PCT Pub. No.: WO2016/156830
PCT Pub. Date: Oct. 6, 2016

(65) Prior Publication Data

US 2018/0111667 A1 Apr. 26, 2018

(30) Foreign Application Priority Data

Mar. 30, 2015 (GB) ..... 1505431.5

(51) Int. Cl.
*B63C 9/04* (2006.01)
*B63B 7/08* (2006.01)

(52) U.S. Cl.
CPC ..... *B63C 9/04* (2013.01); *B63B 7/08* (2013.01); *B63C 2009/042* (2013.01)

(58) Field of Classification Search
CPC ..... B63C 2009/042; B63C 2009/0023; B63B 7/08
See application file for complete search history.

(56) References Cited

U.S. PATENT DOCUMENTS 1,493,664 A * 5/1924 Blum ..... B63C 9/155 137/223
1,981,871 A * 11/1934 Manson ..... B63B 7/082 114/345

* cited by examiner

*Primary Examiner* — Andrew Polay
(74) *Attorney, Agent, or Firm* — Robert D. Atkins; Patent Law Group: Atkins and Associates, P.C.

(57) ABSTRACT

A survival platform, comprising two flexible outer sheets (4, 5), the outer sheets each having a circumference (2) and being sealed together at their circumferences (2) to define a void (18) therebetween, the survival platform further comprising an inner flexible sheet (6) interposed between the outer sheets (4, 5) and dividing the void (18) into two sub-voids (18*a*, 18*b*), and means (8) for inflating the survival platform by introducing a gas into the void to increase a gas pressure therewithin, in which the inner sheet (6) is arranged such that, should one of the outer sheets (4, 5) be breached at a breach, the gas pressure within the void will tend to force the inner sheet (6) through the breach, thereby to block the breach and reduce the level to which gas escapes through the breach.

8 Claims, 4 Drawing Sheets

SURVIVAL PLATFORM

CLAIM TO FOREIGN PRIORITY

The present application is a U.S. National Stage Application filed under 35 U.S.C. 371 from International Application No. PCT/GB2016/050876, filed Mar. 29, 2016, which claims the benefit of priority of United Kingdom Patent Application No. 1505431.5, filed Mar. 30, 2015, which applications are incorporated herein by reference.

This invention relates to a survival platform.

Inflatable survival platforms are well known, such as from the United Kingdom patent application published as GB 2 455 047 A or the International Patent Application published as WO 2010/058205. Generally, they comprise an inflatable body formed of flexible sheets surrounding a void which is filled with a gas and which is released onto the water for users to climb onto. However, such survival platforms suffer from numerous problems, not least that they are liable to deflate should the flexible sheets be breached. Furthermore, it would be desirable to increase the rigidity of such survival platforms and to reduce the amount of gas required to inflate them.

According to a first aspect of the invention, there is provided a survival platform, comprising two flexible outer sheets, the outer sheets each having a circumference and being sealed together at their circumferences to define a void therebetween, the survival platform further comprising an inner flexible sheet interposed between the outer sheets and dividing the void into two sub-voids, and means for inflating the survival platform by introducing a gas into the void to increase a gas pressure therewithin, in which the outer sheet is arranged such that, should one of the outer sheets be breached at a breach, the gas pressure within the void will tend to force the inner sheet through the breach, thereby to block the breach and reduce the level to which gas escapes through the breach.

Therefore, this survival platform is resistant to being breached.

Preferably, the sub-voids are sealed with respect to each other; as such, puncturing one void will not deflate the other.

The survival platform will typically comprise a plurality of reed members, each reed member comprising an elongate body having a length, each reed member joining an outer sheet to the inner sheet along the length, with both outer sheets being joined to the inner sheet by reed members. Thus, these reed members provide structural integrity to the survival platform, providing strength and rigidity, and prevent it being overinflated and hence reduce the amount of gas required to bring the survival platform to an inflation level where it can be used. The reed members may be mutually parallel.

Typically, the reed members will be provided in pairs, with one reed member of each pair joining one of the outer sheets to the inner sheet and the other reed member of each pair joining the other outer sheet to the inner sheet at the same position on the inner sheet but on the opposite face. This is particularly structurally sound.

Each reed member may comprise a tubular body having two opposing faces, one face being joined to an outer sheet and the other face being joined to the inner sheet. Typically, the tubular body can be formed by folding a planar member in two, such that the planar member touches itself at a join. The planar member may be secured to itself at the join.

The inner sheet may have a circumference, and may be joined to the outer sheets at their circumferences.

The survival platform may be provided with a flexible skirt extending from the circumferences of the outer sheets. We have found that such skirts adhere to the surface of water when the survival platform is used, improving the survival platform's stability. Typically, the skirt will extend entirely, or substantially entirely around the circumferences.

The means for inflating the survival platform may comprise a pressurised gas container containing gas which can be released into the void. Alternatively or additionally, it may comprise an orifice for oral inflation.

The survival platform may, when inflated, be substantially planar and so define a plane, which may be a centre plane of the survival platform. The survival platform will preferably be symmetrical, or at least substantially symmetrical, about the plane. Thus, it will not matter which way up the survival platform is thrown into the water.

The freeboard of the survival platform would typically be at most 25 cm, preferably at most 15 cm or 10 cm.

There now follows, by way of example only, description of an embodiment of the invention, described with reference to the accompanying drawings, in which.

Figure 1:
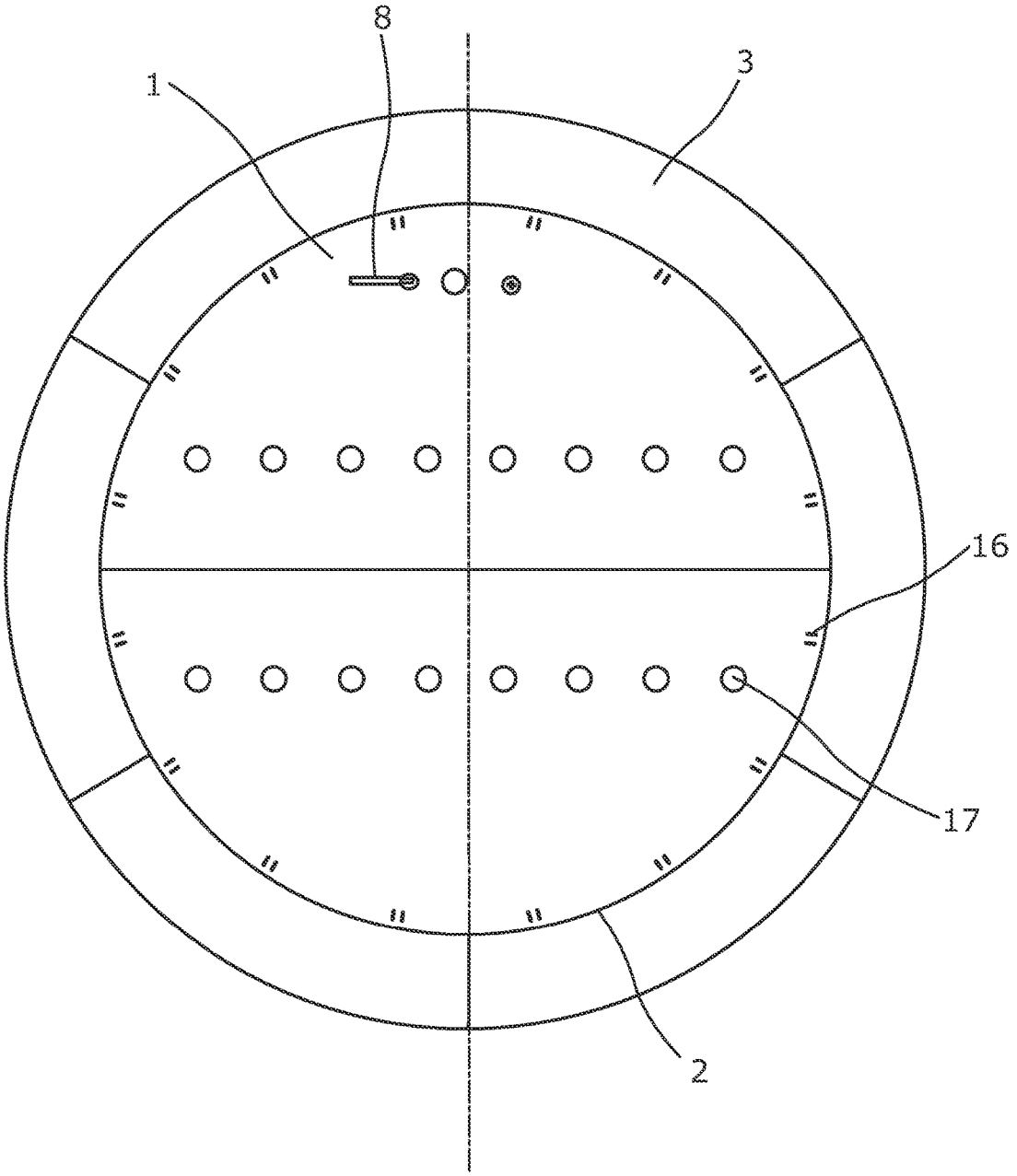
FIG. 1 shows a plan view of a survival platform in accordance with an embodiment of the invention.

A survival platform in accordance with an embodiment of the invention is shown in the accompanying drawings. It comprises a central circular deck 1, having a circumference 2, and a flexible skirt 3 depending therefrom.

The deck 1 comprises two outer sheets 4, 5. These are each circular sheets. Sandwiched between these sheets is an inner sheet 6. All three sheets 4, 5, 6 are welded together at the circumference 2.

Figure 2:
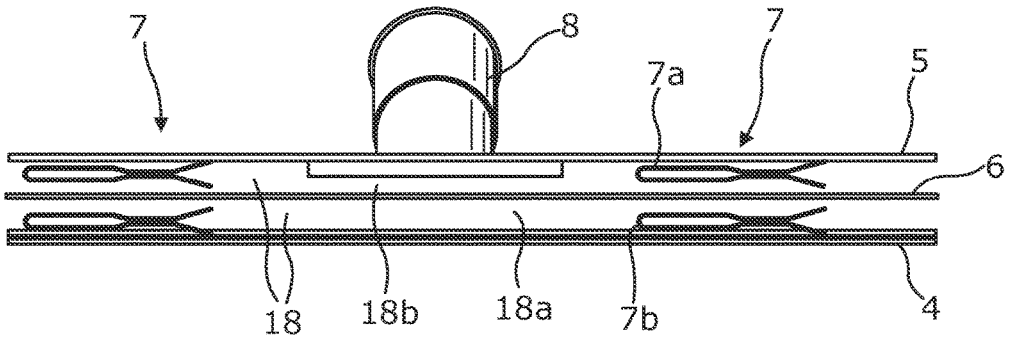
FIG. 2 shows a cross section through the survival platform of FIG. 1, around the inflation port.

The inner sheet 6 is connected to each of the outer sheets 4, 5 through a plurality of elongate parallel reeds 7, provided in pairs, a reed of each pair connecting one of the outer sheets 4, 5 to the inner sheet 6. In the example shown in FIG. 2 of the accompanying drawings, reed 7*a* connects the outer sheet 5 to the inner sheet 6, whereas reed 7*b* connects the outer sheet 4 to the inner sheet 6.

Figure 3:
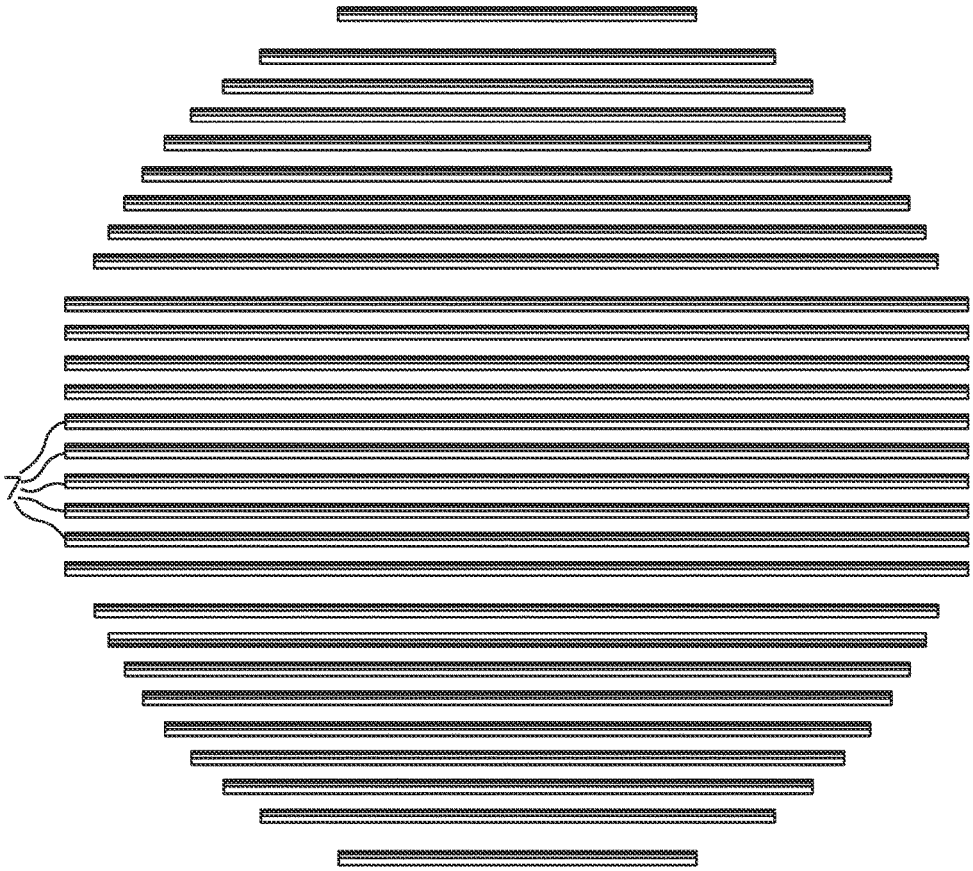
FIG. 3 shows the position of the reeds within the survival platform of FIG. 1.
Figure 4:
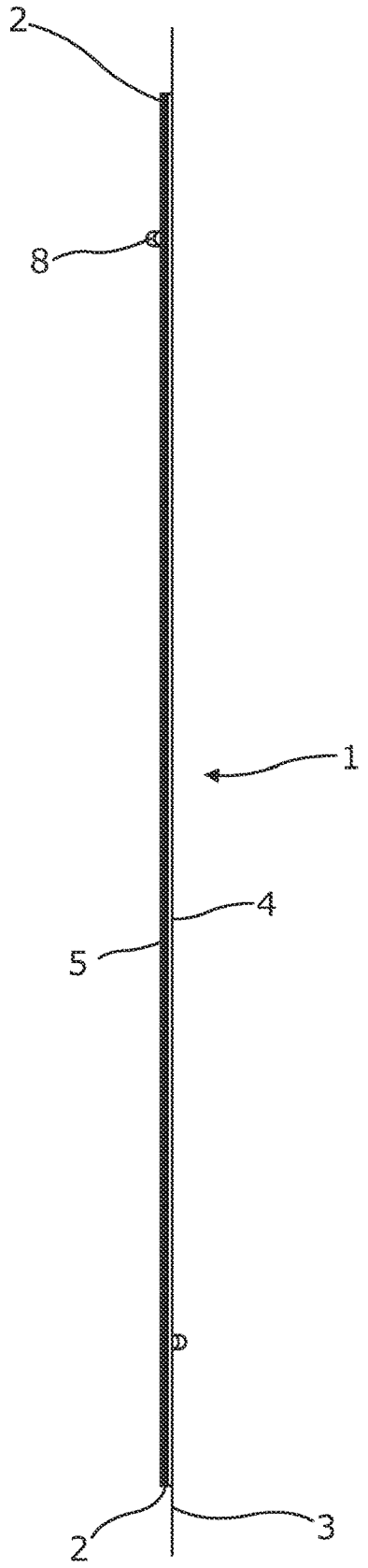
FIG. 4 shows a cross section through the entire survival platform of FIG. 1.
Figure 5:
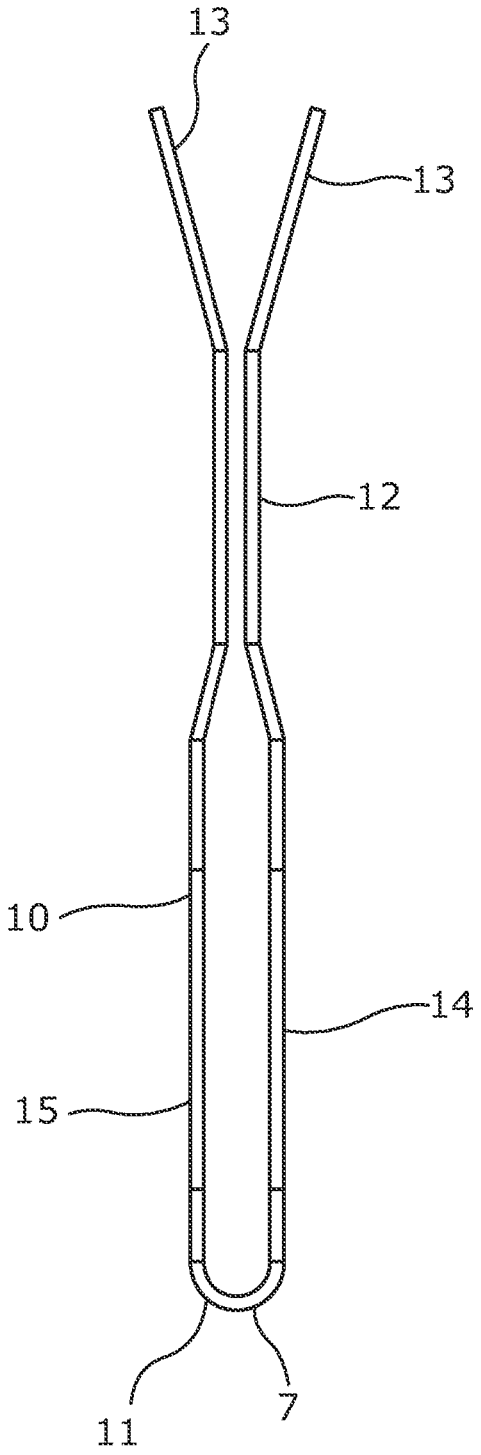
FIG. 5 shows a cross section through one of the reeds of FIG. 3.

As shown in FIG. 5 of the accompanying drawings, each reed 7 comprises a ribbon of material 10 that has been folded back on itself at a fold 11 and joined together by welding at a join 12. This leaves two free ends 13 which are unused, and a tubular body having two faces 14, 15. One face will be welded to each of the sheets 4, 5, 6 to which the reed is attached (so face 14 may be welded to outer sheet 4 or 5, whereas face 15 may be welded to inner sheet 6). For clarity's sake, the welds of the faces 14, 15 to the sheets 4, 5, 6 are not shown in FIG. 2. The position of the reeds 7 through the survival platform is shown in FIG. 3 of the accompanying drawings.

As such, the sheets 4, 5, 6 define between themselves an airtight void 18, which is itself divided into two separate airtight voids 18*a*, 18*b* divided by the inner sheet 6. Air can be introduced to this void through inflation port 8, be it from a gas canister (typically pressurised carbon dioxide) or by oral inflation. The reeds 7 provide rigidity and strength to the survival platform, and mean that less gas is required than otherwise would be the case for sufficient buoyancy and rigidity.

Should there be a breach of one of the outer sheets 4, 5, the inner sheet 6 will stretch and be pressured out of the breach, and act to plug the breach. Whilst some inflation gas may be lost (and so need to be replaced, typically orally), the inner sheet 6 will fill the void and mean that the survival platform can still be inflated and remain buoyant. Furthermore, as there are two separate voids 18*a*, 18*b*, rupture of one void can only depressurise one of the voids, and not the other.

We have found that the skirt 3 as described herein will tend to adhere to the water surface in use, making the survival platform more stable in case of waves, and less likely to overturn.

The survival platform is symmetrical about the inner sheet 6, so that it can be used either way up. As many as 40% of "liferafts" that are thrown into the water end upside down, which can render them useless.

Furthermore, this survival platform has a very low freeboard, typically only 10 cm or so. We have appreciated that a large freeboard can lead to a survival vessel being blown away from the people being rescued. Reducing the freeboard is a way of reducing this problem; we see a survival platform with a low freeboard as we have discussed as particularly innovative.

The survival platform is particularly useful for use in situations where it is important that users of the survival platform get onto the survival platform as quickly as possible and where it is desirable that the survival platform not overturn and be resistant to breaches.

The invention claimed is:

1. A survival platform, comprising two flexible outer sheets, the outer sheets each having a circumference and being sealed together at their circumferences to define a void therebetween, the survival platform further comprising an inner flexible sheet interposed between the outer sheets and dividing the void into two sub-voids, and means for inflating the survival platform by introducing a gas into the void to increase a gas pressure therewithin and force the inner sheet through a breach in the outer sheets, thereby to block the breach and reduce the level to which gas escapes through the breach, the survival platform further comprising a plurality of reed members, each reed member comprising an elongated body having a length, each reed member joining an outer sheet to the inner sheet along the length, with both outer sheets being joined to the inner sheet by reed members, in which the reed members are provided in pairs, with one reed member of each pair joining one of the outer sheets to the inner sheet and the other reed member of each pair joining the other outer sheet to the inner sheet at the same position on the inner sheet but on the opposite face.

2. The survival platform of claim 1, in which the sub-voids are sealed with respect to each other to prevent transfer of fluid.

3. The survival platform of claim 1, in which each reed member comprises a tubular body having two opposing faces, one face being joined to an outer sheet and the other face being joined to the inner sheet.

4. The survival platform of claim 3, in which the tubular body is formed by folding a planar member in two, such that the planar member touches itself at a join.

5. The survival platform of claim 1, in which the inner sheet has a circumference, and is joined to the outer sheets at their circumferences.

6. The survival platform of claim 1, provided with a flexible skirt extending from the circumferences of the outer sheets.

7. The survival platform of claim 1 which, when inflated, is substantially planar and so defines a plane, about which the survival platform is symmetrical, or at least substantially symmetrical.

8. The survival platform of claim 1, in which the freeboard of the survival platform is less than 25 cm.

* * * * *